US007946538B1

(12) United States Patent
Beaman et al.

(10) Patent No.: US 7,946,538 B1
(45) Date of Patent: May 24, 2011

(54) EXTERNAL POINT SPRING LOCKING DEVICE

(76) Inventors: Donald Coy Beaman, Thornton, TX (US); Dilson Santos Rodrigues, Robinson, TX (US); Rick Presley, Bremond, TX (US)

( * ) Notice: Subject to any disclaimer, the term of this patent is extended or adjusted under 35 U.S.C. 154(b) by 13 days.

(21) Appl. No.: 12/653,158

(22) Filed: Dec. 9, 2009

(51) Int. Cl.
*B61L 5/00* (2006.01)

(52) U.S. Cl. ..... 246/393; 246/220; 246/448; 246/435 R

(58) Field of Classification Search ..... 246/22, 246/393, 396, 291, 405, 394, 395, 397, 401, 246/435 R, 448, 449, 450, 451; 324/207.15–207.19
See application file for complete search history.

(56) References Cited

U.S. PATENT DOCUMENTS

| | | | | | |
|---|---|---|---|---|---|
| 2,098,831 | A * | 11/1937 | McGowan | 246/291 |
| 2,656,456 | A * | 10/1953 | Wallace | 246/240 |
| 3,127,138 | A * | 3/1964 | Wilson et al. | 246/393 |
| 3,136,509 | A * | 6/1964 | Magnus | 246/393 |
| 3,355,585 | A * | 11/1967 | Schwab | 246/393 |
| 4,213,588 | A * | 7/1980 | Bowles | 246/259 |
| 5,052,642 | A * | 10/1991 | Peters | 246/393 |
| 5,531,408 | A * | 7/1996 | Wechselberger | 246/257 |
| 5,620,156 | A * | 4/1997 | Berggren et al. | 246/221 |
| 5,669,587 | A * | 9/1997 | Van Alstine et al. | 246/220 |
| 5,730,395 | A * | 3/1998 | Carmes | 246/448 |
| 5,806,809 | A * | 9/1998 | Danner | 246/220 |
| 6,138,959 | A * | 10/2000 | Wydotis et al. | 246/406 |
| 6,168,120 | B1 * | 1/2001 | Pease | 246/405 |
| 6,454,221 | B1 * | 9/2002 | Bonfigli | 246/415 R |
| 6,578,799 | B1 * | 6/2003 | Brushwood | 246/220 |
| 6,585,194 | B1 * | 7/2003 | Brushwood | 246/220 |
| 6,688,559 | B1 * | 2/2004 | Brushwood | 246/220 |
| 7,168,662 | B1 * | 1/2007 | McQuistian et al. | 246/449 |
| 7,699,272 | B2 * | 4/2010 | Arnold | 246/220 |
| 7,753,318 | B2 * | 7/2010 | Wagner et al. | 246/220 |
| 2001/0054670 | A1 * | 12/2001 | Franke | 246/220 |
| 2005/0178929 | A1 * | 8/2005 | Biagiotti | 246/449 |
| 2006/0208137 | A1 * | 9/2006 | Scheer | 246/393 |
| 2009/0072097 | A1 * | 3/2009 | Arnold | 246/220 |
| 2009/0242706 | A1 * | 10/2009 | Mugg | 246/435 R |
| 2010/0072326 | A1 * | 3/2010 | Click et al. | 246/393 |

* cited by examiner

*Primary Examiner* — S. Joseph Morano
*Assistant Examiner* — Jason C Smith
(74) *Attorney, Agent, or Firm* — Thrasher Associates

(57) ABSTRACT

The invention provides an external spring-loaded locking device for use with railroad switches. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims.

15 Claims, 5 Drawing Sheets

120
250
220
245
225
255
260
252
254
256
215
240
230
210

EXTERNAL POINT SPRING LOCKING DEVICE

FIELD OF INVENTION

The present application relates to railroad automated switches.

PROBLEM STATEMENT

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Problem Statement is to be construed as prior art.

Discussion

A railroad track switch is a switch that changes the track alignment between two railroad tracks, and is known to those of skill in the railroad arts. Unfortunately, some railroad switch locations are insufficiently braced for secure switch operation, which can lead to derailment. Accordingly, there is a need for an apparatus that is automated to sufficiently brace these switches. The present application discloses such a device.

BRIEF DESCRIPTION OF THE DRAWINGS

Various aspects of the invention, as well as an embodiment, are better understood by reference to the following detailed description. To better understand the invention, the detailed description should be read in conjunction with the drawings and tables, in which.

EXEMPLARY EMBODIMENT OF A BEST MODE

Interpretation Considerations

Figure 1:
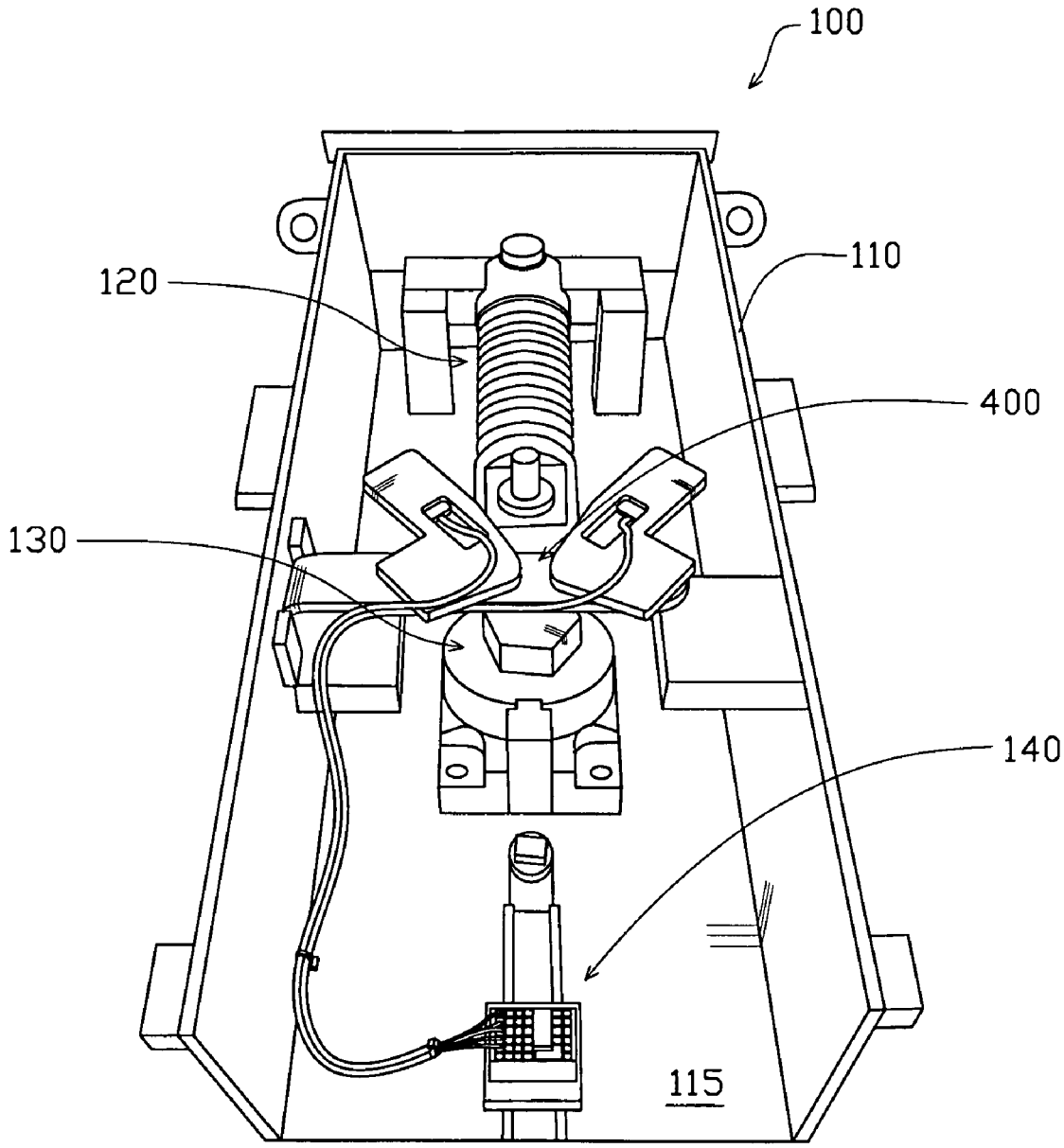
FIG. 1 shows the EPSL apparatus.

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching").

Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for—functioning—" or "step for—functioning—" in the Claims section. Sixth, the invention is also described in view of the Festo decisions, and, in that regard, the claims and the invention incorporate equivalents known, unknown, foreseeable, and unforeseeable. Seventh, the language and each word used in the invention should be given the ordinary interpretation of the language and the word, unless indicated otherwise.

As will be understood by those of ordinary skill in the art, various structures and devices are depicted in block diagram form in order to avoid unnecessarily obscuring the invention. As used, herein and the accompanying drawings, B12 refers to positive 12 volts, and N12 refers to negative 12 volts. Additionally the term "set" refers to the application of 12 volts (B12), while the term "reset" refers to the removal of 12 volts.

Some methods of the invention may be practiced by placing the invention on a computer-readable medium, particularly the control and detection/feedback methodologies. Computer-readable mediums include passive data storage, such as a random access memory (RAM) as well as semi-permanent data storage such as a compact disk read only memory (CD-ROM). In addition, the invention may be embodied in the RAM of a computer and effectively transform a standard computer into a new specific computing machine.

Data elements are organizations of data. One data element could be a simple electric signal placed on a data cable. One common and more sophisticated data element is called a packet. Other data elements could include packets with additional headers/footers/flags. Data signals comprise data, and are carried across transmission mediums and store and transport various data structures, and, thus, may be used to operate the methods of the invention. It should be noted in the following discussion that acts with like names are performed in like manners, unless otherwise stated. Of course, the foregoing discussions and definitions are provided for clarification purposes and are not limiting. Words and phrases are to be given their ordinary plain meaning unless indicated otherwise.

DESCRIPTION OF THE DRAWINGS

The present invention is an external point spring locking apparatus (EPSL). The external point spring locking device has a positive and reliable locking point with redundant point detection which minimizes the chances for error and railroad malfunctions. The EPSL is mountable upon head block ties and in the disclosed embodiment couples to a railroad track's switch points opposite of a railroad track's switch machine. Preferably driven by a separate power switch machine, the EPSL alternately compresses and releases a heavy-duty steel spring to provide an additional holding force, preferably approximately 726 kg (1600 lbs), at the switch points, in each of the switch's positions. However, it is appreciated that those of skill in the art upon reading this disclosure will understand that other pound-holding forces are available, and, in one embodiment, adjustable. The apparatus can be installed and maintained with the use of regular hand tools, typically including a pick, shovel, center punch, hammer, cordless drill, and standard wrenches. The preferred embodiment has an all steel construction.

Shown in FIG. 1 is the EPSL 100 apparatus. Not shown is a lid which may be completely removable, or hinged to be opened. The EPSL 100 includes an environmentally resilient case 110, a spring lock assembly system 120, a spindle assembly system 130, and an electrical system 140. Each of the systems will be discussed in further detail below.

In a preferred embodiment, the case's 110 dimensions are: length "L"—86 cm (34 in.), width "W"—57 cm (22½ in.), and height "H"—23 cm (9 in.). The case 110 is made of corrosion resistant material, preferably stainless steel, but other sizes and weather resistant materials such as steel with a weather resistant coating or hard plastics may be used. The Case 110 has a base-plate 115 which has a hole for the spindle shaft system 130 to couple outside, the railroad track's switch points, to the EPSL 100 inside.

Figure 2:
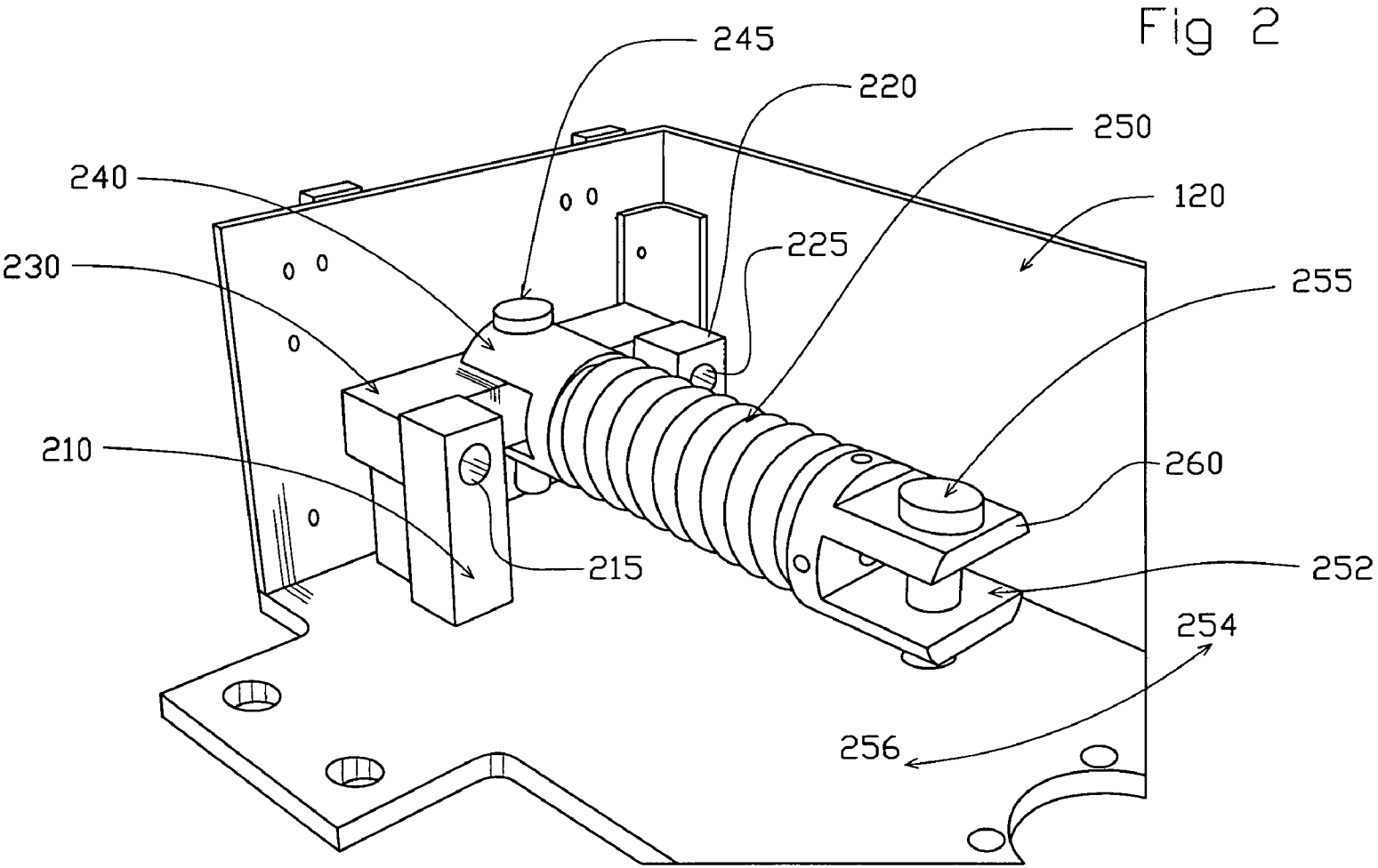
FIG. 2 illustrates the lock spring assembly system.

Shown in FIG. 2 is the lock spring assembly system 120. The lock spring assembly 120 contains, and directs the substantial energy generated as the EPSL is driven through its operating cycle. A first mounting bar 210 and a second mounting bar 220 are fastened to the case with two bolts 215, 225. The mounting bars 210, 220, hold a pivot block 230 in place. The pivot block 230 secures a first clevis 240 with a first clevis pin 245, which allows a lock spring 250 to swivel horizontally, but maintain a secured pivot point.

A lock spring guide rod (not shown, but known to those of ordinary skill in the art) is inside a lock spring 250 and couples a first clevis 240, and a second clevis 260 at the ends of the lock spring 250. This allows the first clevis 240 and second clevis 260 to telescope toward each other, to compress the lock spring 250 and build up force, and away from each other to achieve different positions. The second clevis 260 couples the lock spring 250 to an operating lever 310 (shown in FIG. 3) by the second clevis pin 255. Both of the first and second clevis pins 245, 255 require some form of lubrication, as is known in the art.

The operating cycle of the lock spring assembly system 120 is a cycle of pendulum-like movement. The fixed point is at the first clevis pin 245. The front 252 of the lock spring 250 moves horizontally from one side 254, a first position defined as the NORMAL position, of the case 100 to the other 256, the second position defined as the REVERSE position. The positions 254, 256 are located approximately at the peaks of the pendulum-like movement. At each position 254, 256 of the pendulum-like movement, the lock spring 250 preferably generates at least 726 kg (1600 lbs.) of compression force.

Figure 3:
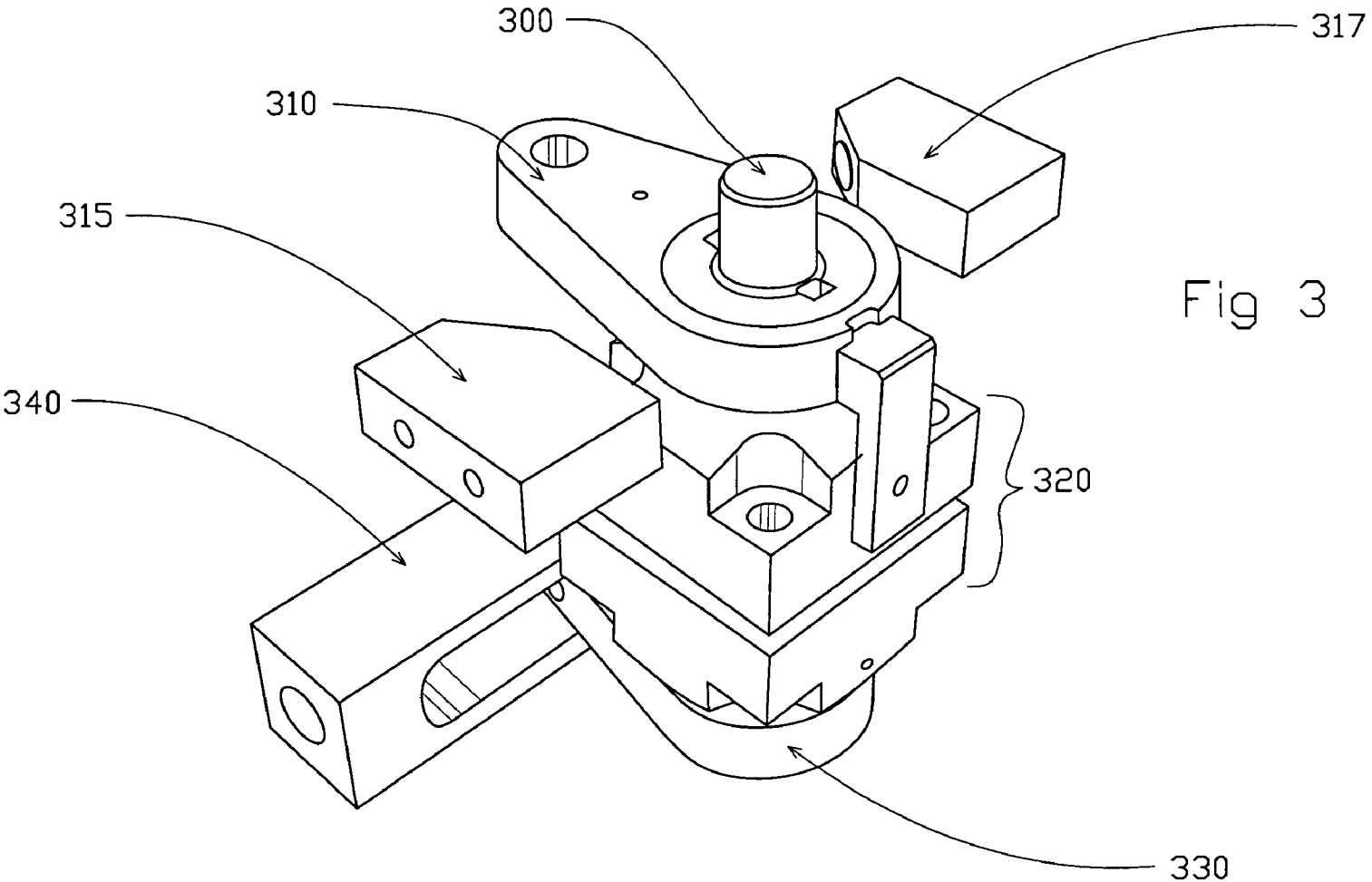
FIG. 3 shows the spindle assembly system.

FIG. 3 shows the spindle assembly system 130 in more detail, which generally comprises a spindle shaft 300, an operating lever 310, a bearing housing 320 and a point lever 330. The spindle assembly system transfers the spring energy of the EPSL 100 to the railroad tracks' switch points. At the center of the spindle assembly system is the spindles shaft 300, which is the component that transfers the energy.

The operating lever 310 has a lock spring system force pushing it. To protect against failure, the ESPL 100 has a first operating lever stop block 315, proximate to a first position and a second operating stop block 317 proximate to a second position. The stop blocks 315, 317 limit the movement of the operating lever 310. The point lever 330 is secured to the spindle shaft 300 to move in uniformity with the operating lever 310. The point lever 330 is connected to the railroad switch by a point lever clevis 340. Thus, in the EPSL 100, the energy of the lock spring 250 is transferred to the operating lever 310 to the spindle shaft 300 to the point lever 340 to the railroad switch. The sensor mounting bracket 420 is secured to the case 110. The sensor mounting bracket 420 can be secured using one of many securing means such as welds or bolts, preferably as in this design a support bracket 430 and bolts.

Figure 4:
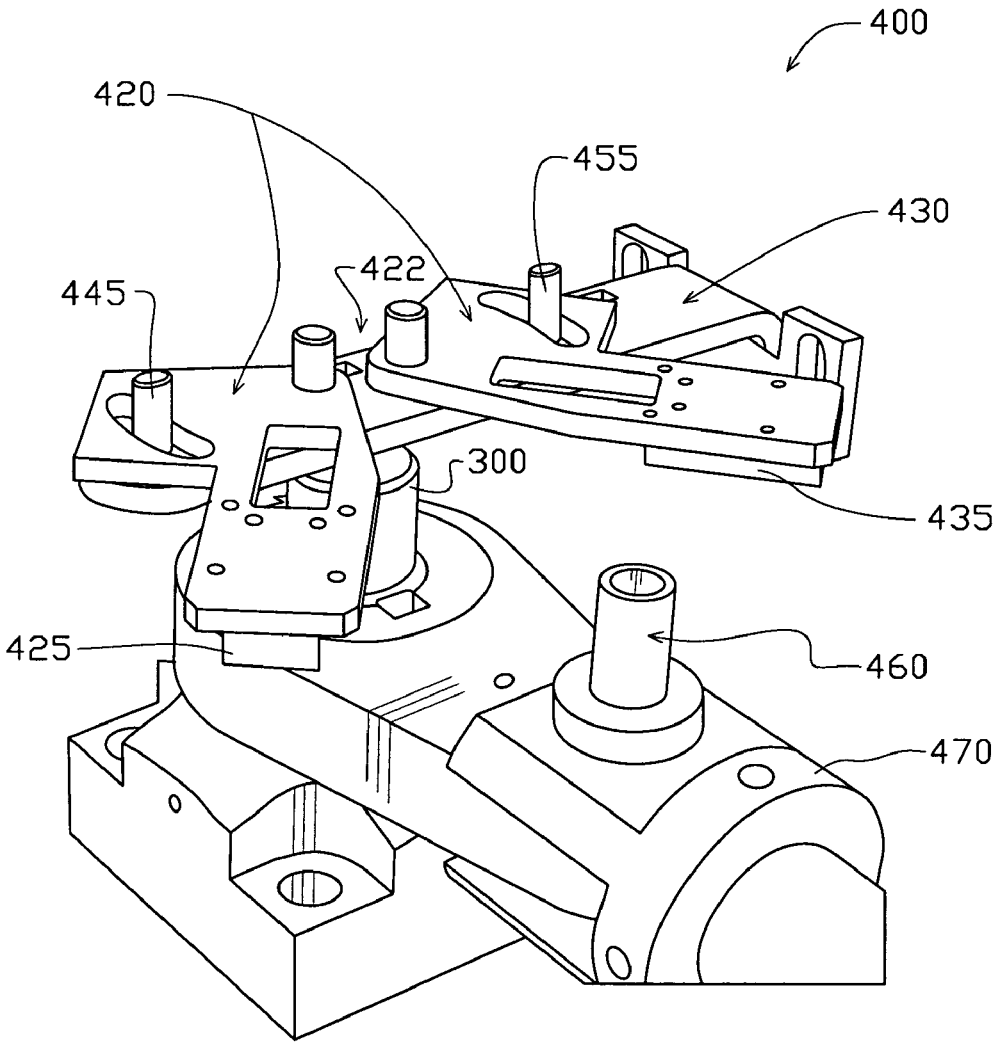
FIG. 4 shows the point detection system.

The point detection system 400 is shown in FIG. 4. The point detection system provides redundant switch point position information to the power assisted switch control system, not shown. The point detection system 400 is shown in FIG. 4. The point detection system 400 has a flat mounting bar 410 also known as a sensor support arm, which secures the sensor mounting bracket 420. The sensor mounting bracket 420 can be in one of many shapes preferably as shown "V" shape. The sensor mounting bracket 420 has its point 422 of the V centered above the spindle shaft 300. The sensor mounting bracket 420 has a first sensor 425 and a second sensor 435 which are attached beneath the sensor mounting bracket 420 opposite the spindle shaft 300.

The sensor mounting bracket 420 is preferably fixed, and may be drilled and slotted to provide pegs. A first peg 445 and a second peg 455 enable adjusting the sensor mounting bracket configuration in proximity to the sensor target 460. The sensor target 460 is bolted to the top of the second clevis 470 and alternately moves under each of the sensors 425, 435 as the EPSL 100 runs through its operating cycle. When the proximity sensor target 460 can oscillate between the points where it is directly beneath the sensors 425, 435, the sensor mounting bracket 420 is in the proper position for operation. The sensor mounting bracket 420 is secured in position by lock nuts (not shown but understood by those of ordinary skill in the art) over the pegs 445, 455.

Figure 5:
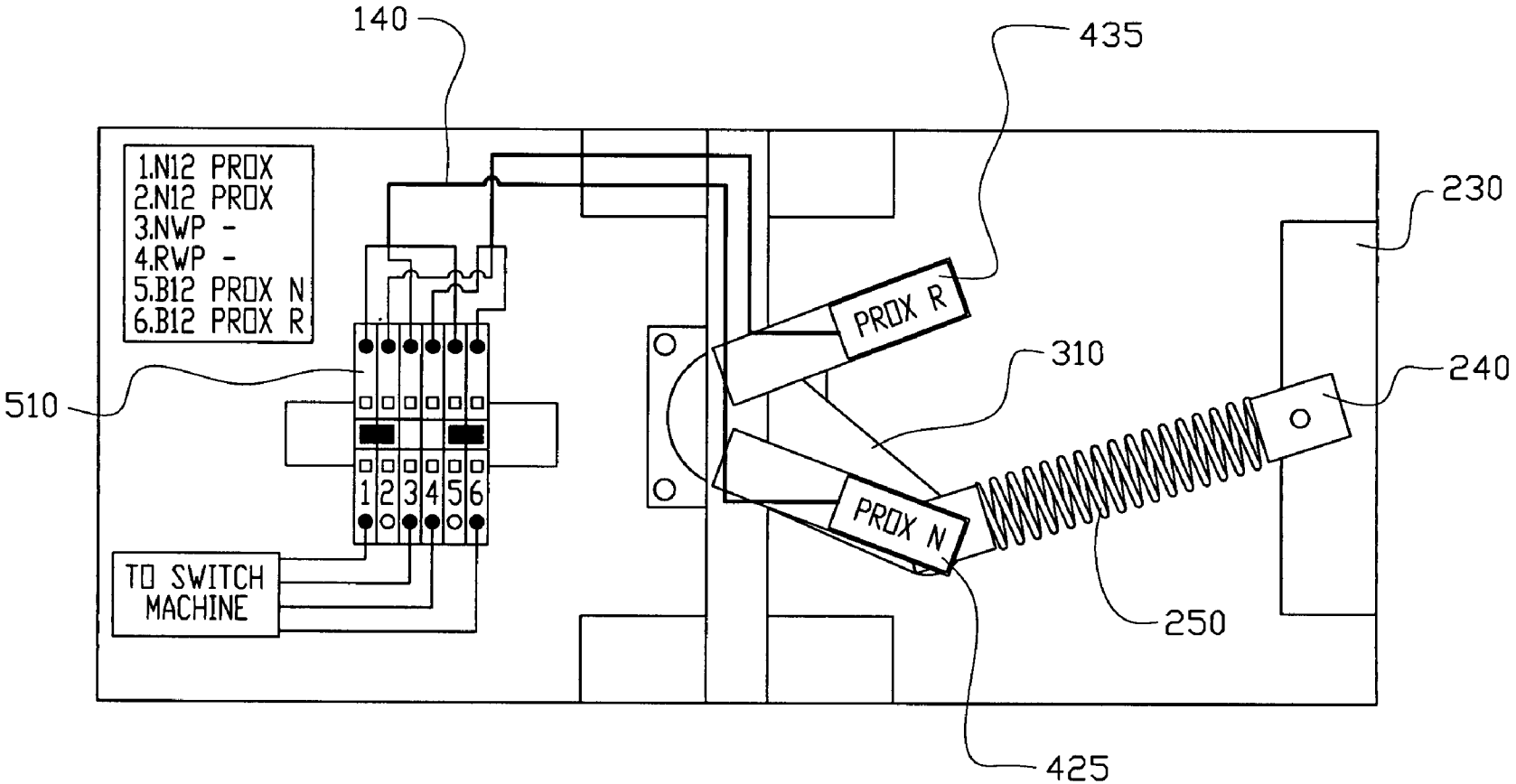
FIG. 5 illustrates the electrical system.

The electrical system 140 is shown in FIG. 5. The electrical system 140 comprises a terminal block 510 and the electrical wiring which couples the terminal block 510 to the proximity sensors 425, 435. The pivot block 230 is connected to the first clevis 240, to the lock spring 250, to the operating lever 310, under the sensor 425. In this position, the EPSL 100 is in the Normal position. When the operating lever 310, and lock spring 250 pivot in the alternate direction where the operating lever 310 is located directly below the sensor 435, the EPSL 100 is in the Reverse position.

The terminal block 510 may be any acceptable electronic communicative systems sufficient for the EPSL 100. The electrical system 140 needs to send and retrieve messages from the sensors regarding the position of the lock spring 250.

In the preferred embodiment, the terminal block is preferably a WAGO terminal block. The electrical system 140 can relay that output to an outside source.

The EPSL 100 "rests" in the NORMAL position. When the EPSL 100 receives an electronic signal from the WAGO terminal, the EPSL 100 transfers from the NORMAL position to the REVERSE position. At rest in the NORMAL position, the EPSL 100 applies a holding force preferably 726 kg (1600 lbs.), to the railroad tracks' switch points in addition to the holding force applied by the railroad tracks' switch machine. The proximity sensor target 460 is directly under the proximity sensor 425, generating a 12 VDC Normal output to the railroad tracks' switch control system.

When the signal is received to switch into the REVERSE position, the process of switching begins. Because the EPSL 100 is directly connected to the railroad tracks' power switch machine through its linkage to the railroad tracks' switch points, the power switch machine must first overcome the holding force applied by the EPSL 100 when it tries to move the switch points. As the points begin to move to the REVERSE position, they in turn drive the spindle assembly system 120 which begins to compress the lock spring 250. The sensor target 460 moves away from the NORMAL sensor 425 and the 12 VDC output is lost. As the switch points travel to mid-stroke the resistance of the EPSL 100 is increasing as the lock spring 250 is compressed. When the switch points are at the half throw the spindle reaches the neutral point with the operating lever 310 directly in the line with the lock spring 250. This is the point of maximum resistance. As the points move beyond the half-throw the operating lever 310 moves past the neutral point and the spring begins to unload, adding its force to the switch machine, and helping to close the switch points in the REVERSE position. As the points close the proximity sensor target 460 in the EPSL 100 moves under the REVERSE proximity sensor 435 and triggers the −12 VDC REVERSE output to the switch control system. Again, at rest in the REVERSE position, the EPSL 100 provides an additional holding force to keep the switch points closed.

Closing Caveat

Of course, it should be understood that the order of the acts of the algorithms discussed herein may be accomplished in different order depending on the preferences of those skilled in the art, and such acts may be accomplished as software, and that equivalent methods (and portions of methods) having equivalent or substantially similar ends may be substituted, and are readily apparent to those of ordinary skill in the art after reading this disclosure. Furthermore, though the invention has been described with respect to a specific preferred embodiment, many advantages, variations and modifications will become apparent to those skilled in the art upon reading the present application. It is therefore the intention that the appended claims and their equivalents be interpreted as broadly as possible in view of the prior art to include all such variations and modifications.

We claim:

1. An apparatus for bracing a railroad switch point comprising:

an environmentally resilient case;

a lock spring assembly system comprising a pivot block having a hole receiving a first clevis pin that secures a first clevis to the pivot block, while allowing the first clevis to swivel in a horizontal motion, the lock spring assembly system also comprising a first mounting bar secured to the case and the pivot block, and a second mounting bar secured to the case and the pivot block on an opposite side of a lock spring;

coupled between the first clevis and a second clevis is the lock spring;

a spindle assembly system coupled to the second clevis by a second clevis pin, the spindles assembly system comprising a spindle shaft, an operating lever located above a base plate, the operating lever coupled to a spindle shaft to move in a simultaneous motion with and aligned with a point lever which is coupled to the end of the spindle shaft opposite the operating lever, the point lever being coupled to a clevis for securing a railroad switch, the spindle shaft is mated to the case with at least one bearing housing about the spindle shaft;

a point detection system, comprising a sensor mounting bracket attached to the case, and a first proximity sensor secured to the mounting bracket at a first position and a second proximity sensor secured to the mounting bracket at a second position, each proximity sensor being electrically coupled to an electrical terminal block, the electrical terminal block also being electrically coupleable to a railroad switch machine;

the proximity sensors are positioned above the spindle shaft;

a proximity sensor target secured to the second clevis.

2. The apparatus in claim 1 in which the lock spring has a holding force greater than equal to 750 kg (1600 lbs.).

3. The apparatus in claim 2 in which the spring is comprises of a chromium alloy steel.

4. The apparatus in claim 2 in which the spring is a coil spring.

5. The apparatus in claim 1 having a one or more operating stop blocks mounted on the case wall minimize movement range of the operating lever and spindle shaft.

6. The apparatus in claim 1 having a spindle lock bar to secure the operating lever and spindle shaft in one position.

7. The apparatus in claim 1 in which the operating lever and point lever are keyed to be secured to the spindle shaft to create consistent movement relationship.

8. The product in claim 1 in which the sensor mounting bracket is V-shaped with one proximity sensor located at each of the top points of the V and the proximity sensor target located in between the V section secured to the lock spring assembly system.

9. The apparatus in claim 1 in which the proximity sensors are inductive proximity sensors.

10. The product in claim 9 in which the inductive proximity sensors are 3-wire type NPN-NO.

11. The product in claim 10 in which the proximity sensors have a 12 VDC Output.

12. The product in claim 11 in which an operating voltage range comprises 12 VDC.

13. The product in claim 12 in which an operating current is 10 mA.

14. The apparatus in claim 1 in which the case dimensions are length is 86 cm (34 in.), the width is 57 cm (22½ in.) and the height is 23 cm (9 in.).

15. The apparatus in claim 14 in which the case has a removable lid.

* * * * *